United States Patent [19]

Kral et al.

[11] 4,171,781

[45] Oct. 23, 1979

[54] COPYING APPARATUS

[75] Inventors: Rainer Kral, Stuttgart; Kurt Moser, Gerlingen; Heinrich Kaufmann, Stuttgart, all of Fed. Rep. of Germany

[73] Assignee: Develop KG Dr. Eisbein & Co., Gerlingen, Fed. Rep. of Germany

[21] Appl. No.: 888,584

[22] Filed: Mar. 20, 1978

[30] Foreign Application Priority Data

Apr. 20, 1977 [DE] Fed. Rep. of Germany ..... 2717461

[51] Int. Cl.[2] ..... B65H 17/02

[52] U.S. Cl. ..... 242/68.4; 242/68.2

[58] Field of Search ..... 242/68, 68.2, 68.3, 242/68.4, 129.51

[56] References Cited

U.S. PATENT DOCUMENTS

| | | | |
|---|---|---|---|
| 1,693,876 | 12/1928 | Unruh | 242/68.4 |
| 2,009,972 | 7/1935 | Marchev | 242/68.4 |
| 2,922,592 | 1/1960 | Kaltenbach | 242/68.2 |
| 3,018,977 | 1/1962 | Skallquist | 242/68.4 X |
| 3,275,257 | 9/1966 | Cherniavskyj | 242/68.3 |
| 4,045,038 | 8/1977 | Obenshain | 242/68.4 |

*Primary Examiner*—Edward J. McCarthy

*Attorney, Agent, or Firm*—William Anthony Drucker

[57] ABSTRACT

A copying apparatus with a paper roll wound on a sleeve, a pair of roll holders having lugs frictionally held in the ends of the sleeve, each roll holder being provided with a journal pin adapted to engage an associated guide mounted on the copying apparatus.

8 Claims, 5 Drawing Figures

COPYING APPARATUS

BACKGROUND OF THE INVENTION

1. Field of the Invention

The invention relates to an arrangement, in a copying apparatus, of a paper roll which is wound on a sleeve and is held in guides in the copying apparatus with the aid of roll holders, which are supported on the sleeve, and is inserted with its beginning in a take-off roller pair.

2. Description of the Prior Art

It is known to place the roll holders on a common shaft which is then inserted into the copying apparatus. This necessitates a rather elaborate and expensive construction which entails a somewhat time-consuming mode of operation for the exchange of paper rolls. In the case of this construction, the user has to take care that he inserts the paper roll correctly into the copying apparatus, i.e. that it is ensured that the coated side of the paper subsequently runs in the copying apparatus so that it is directed towards the means provided for producing a copy. If several persons have access to the copying apparatus and are also authorised to exchange paper rolls, which may be the case, for example, in large offices or in libraries or the like places, then the danger exists that a person who is not familiar with the apparatus will insert the paper roll incorrectly. It is then impossible to produce copies, which will cause the person in question to call for a service man. This may increase the costs of an apparatus and, in particular, may also be detrimental to the reputation of an apparatus manufacturer.

SUMMARY OF THE INVENTION

The task underlying the invention is to provide an arrangement of the kind mentioned at the beginning which can be produced as simply and economically as possible and by means of which mix-ups are prevented to the greatest possible extent. The invention consists in that the roll holders are inserted with the aid of lugs into the sleeve, at the front ends thereof, and are frictionally held therein in the axial direction and in that each roll holder is provided with a journal pin, the journal pins being of different shape, which is adapted to the associated guide.

The roll holders themselves are of simple construction and are therefore easy to produce. Since no continuous shaft is used, it is also easy to fit them on the respective roll, in that they are simply placed with the respective lugs into the front ends of the roll. Due to the frictional connection, they are then held therein of their own accord. Due to the different journal pins and guides used at each end, an incorrect insertion of the paper roll into the copying apparatus is no longer possible. The respective person is of necessity caused to insert the paper roll correctly into the apparatus.

In order to provide, in a further development of the invention, that the two roll holders are fitted correctly and are prevented from being fitted on the wrong sides, provision is made, in a further development of the invention, for a front end of the sleeve to have a profiling that corresponds to a profiling of the lug of one of the two roll holders. By this means, it is determined from the outset that one of the two roll holders is associated with one front end of the paper roll sleeve, so that this roll holder can only be fitted thereto. In addition to the subsequent inevitably correct insertion into the copying apparatus, this measure leads to a fool-proof operation thereof.

In a further development of the invention, provision is made for a journal pin to be fitted so as to be axially movable in the associated roll holder and to be supported against the roll holder with the aid of a compression spring. This ensures that, irrespective of the care taken by the person carrying out the insertion, the paper roll is always arranged in a very specific axial alignment after its insertion, so that the adjustment, effected in the apparatus, of a feed edge for the originals to be copied in relation to a side edge of the paper web wound on the paper roll is always exactly maintained.

In a further development of the invention, provision is made for preferably the non-driven roller of the take-off roller pair to be connected, via a free wheel, to a draw-in lever which is resiliently held in its position of rest and drives the associated roller when the take-off roller pair is swung in the transport direction. The actuation of the draw-in lever makes it possible to draw the beginning of the paper web, wound on the paper roll, exactly between the take-off rollers. Here, too, a very simple actuating operation, which has no influence on the control of the entire apparatus and does not act on it, has to be carried out.

In an expedient development of the invention, provision may furthermore be made for there to be arranged in the movement path of the draw-in lever, at as small a distance from the axle of the associated roller as possible, a stop which lies in a plane extending through 90° in relation to a plane which is taken through the axles of the take-off roller pair and in which the roller connected to the draw-in lever is held in a guide so as to be movable against the force of a spring. By this means, it is made possible in a very simple manner for the two take-off roller pair rollers to be pressed at least unilaterally somewhat apart by the actuation of the draw-in lever, so that the clamping of the paper web is largely cancelled and the latter can be withdrawn from the take-off roller pair.

DESCRIPTION OF THE PREFERRED EMBODIMENT

Figure 1:
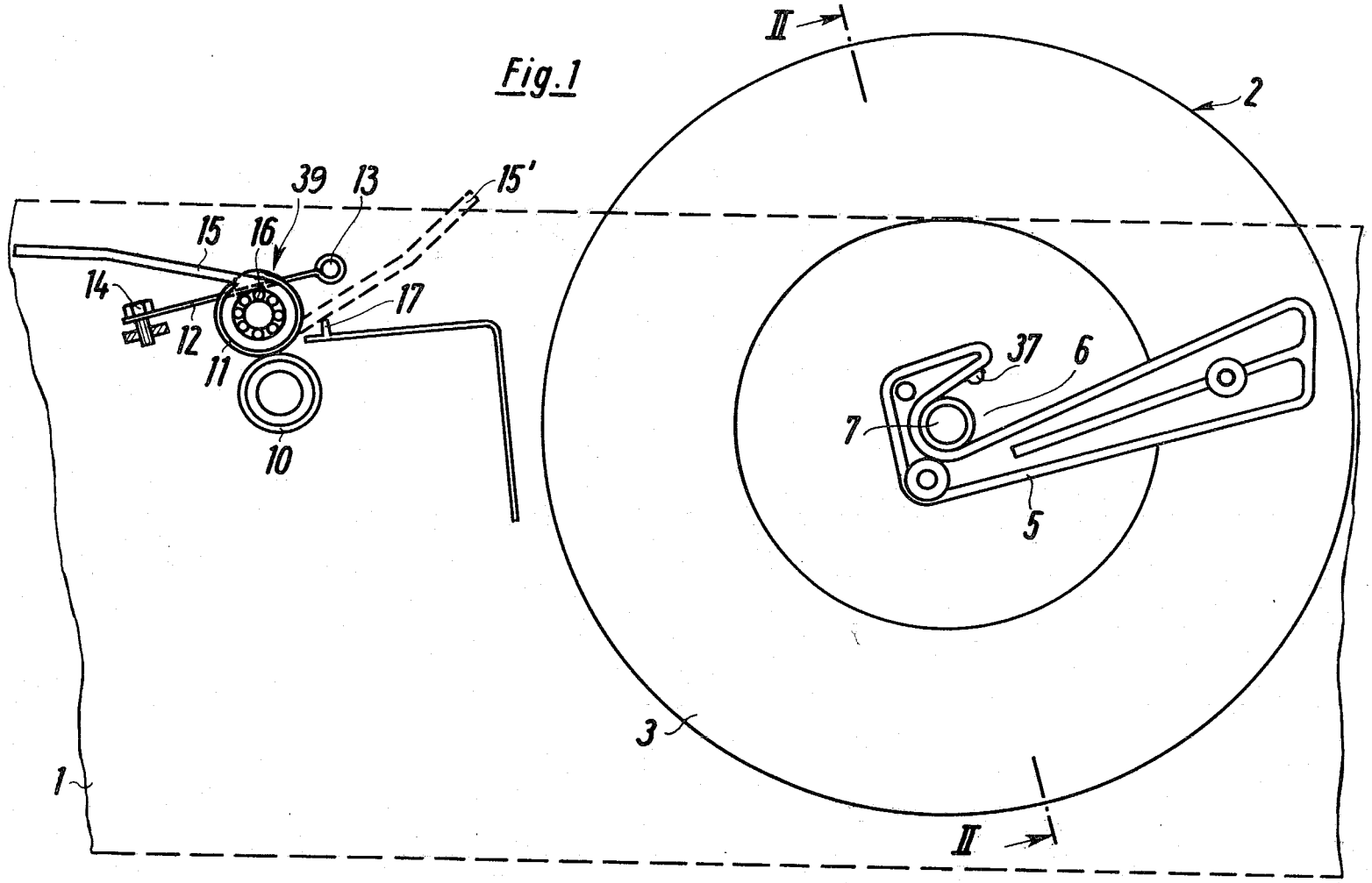
FIG. 1 shows a diagrammatical view of a paper roll arrangement, according to the invention, in a copying apparatus.

In FIG. 1, there is shown in broken lines the bottom part 1 of a copying apparatus, from which a housing top part can be swung away or lifted off, so that the area of a paper roll 2 and a take-off roller pair 3 can be exposed. The paper roll 2 is held by two lateral roll holders 3 and 4, which are rotatably mounted in guides 5 which are laterally attached to housing walls and each comprise an obliquely upwardly inclined U-shaped receiving slot 6 for the journal pins 7 and 8 of the roll holders 3 and 4.

Figure 2:
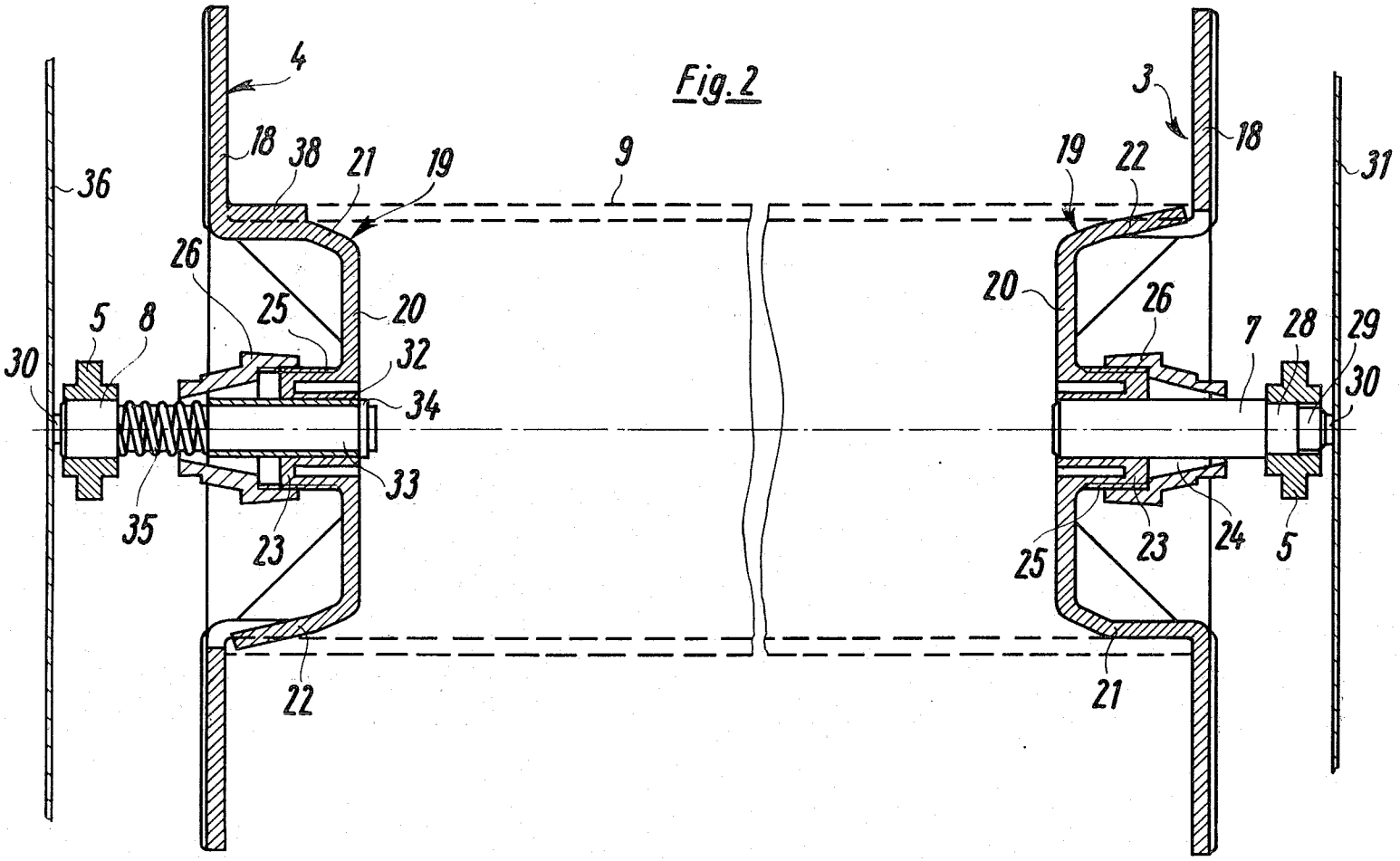
FIG. 2 shows a section along the line II—II of FIG. 1.
Figure 3:
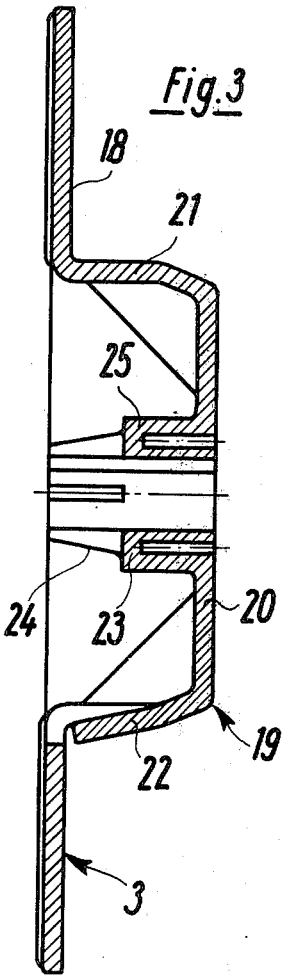
FIG. 3 shows a detail of FIG. 2.
Figure 4:
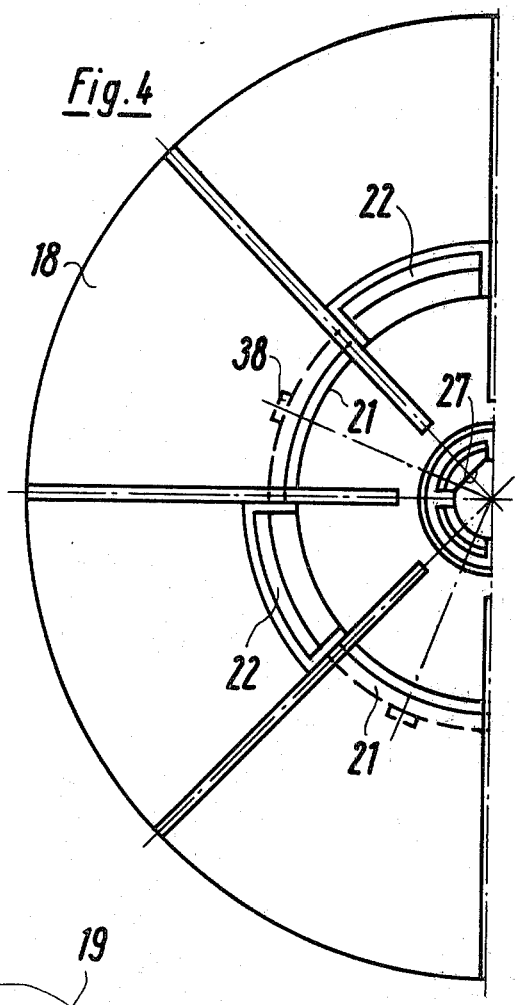
FIG. 4 shows a view of the detail of FIG. 3 in the axial direction from the outside.
Figure 5:
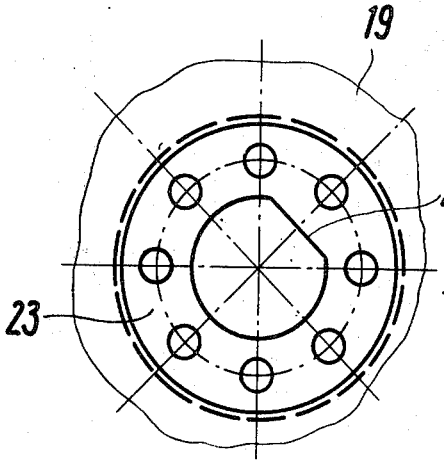
FIG. 5 shows a partial view of the detail of FIG. 3 in the axial direction as seen from the roll interior.

The paper web wound on a sleeve 9, which is indicated in broken lines in FIG. 2, is—relatine to the view of FIG. 1—drawn off at the top, so that the paper roll 2 rotates during this process in the anti-clockwise sense.

The beginning of the paper web is inserted into the take-off roller pair 39.

The take-off roller pair consists of a lower take-off roller 10 and an upper take-off roller 11, whose axles lie in a common plane, which is slightly inclined towards the vertical line. The lower take-off roller 10 is driven, in a manner not shown in detail, by a chain drive connected to the total drive of a copying apparatus. The upper roller 11 is arranged in a slot guide (not shown) which is located parallel to the plane of the axles of the rollers 10 and 11. It is pressed against the lower roller 10 with the aid of two laterally fitted compression springs 12. The compression springs 12 are designed as leaf springs which can be looped, with one end, around a pin 13 and can be tensioned, at the other end, with a screw 14, so that the clamping pressure between the rollers 10 and 11 can be adjusted.

The upper roller 11 is connected to the draw-in lever 15 via a free wheel 16. The draw-in lever 15 can be swung from the position shown in solid lines in FIG. 1 through approximately 180° to the position 15' shown in broken lines. During this swivelling, the upper roller 11 is co-rotated, via the free wheel 16, in the transport direction of the take-off roller pair 3, so that the beginning of the paper web inserted in the gap between the two rollers 10 and 11 is drawn in. This drawing-in is therefore effected by a purely mechanical action without any involvement of the control or actuating means of the entire copying apparatus.

In the position shown in broken lines in FIG. 1, the draw-in lever 15 rests against a stationary stop 17 which may consist, for example, of a tongue bent upwards from a plate cover. The stop 17 is arranged as closely as possible to the axle of the upper roller 11, i.e. the swivel axis of the draw-in lever 15. If the draw-in lever 15 is loaded more heavily in its position 15', then this force is transferred with a transmission to the upper roller 11, which is then slightly lifted against the action exerted by the compression spring 12. By this means, it is possible for the clamping effect between the rollers 10 and 11 to be largely or even completely cancelled, so that the paper web can be easily pulled out to the rear between the two rollers 10 and 11. This is important whenever the paper roll 2 has been used up and a new roll is to be inserted. In this case, the remainder left in the area of the take-off rollers 3 has to be removed, which is greatly facilitated by the described measure.

The two roll holders 3 and 4 consist of injection-moulded plastics material parts which each have an annular flange 18 in the area of the wound paper web and an approximately cylindrical lug 19, by means of which they are placed into the interior of the sleeves 9. The lugs 19 consist of several areas 21, which are rigidly connected to the annular flanges 18 and a hub part 20 respectively (FIG. 2), and areas 22 which are located therebetween and yield resiliently in the radial direction and are separated from the area of the annular flanges 18 by slots. In the area of the elastically resilient parts 22, the lugs have an outside diameter which is somewhat larger than the inside diameter of the sleeve 9, so that they can only be placed into the sleeve 9 after an elastic deformation of the parts 22. This elastic deformation causes the roll holders 3 and 4 to be frictionally held in a sleeve 9 without any other additional measures.

The roll holder 3, shown on the right-hand side in the drawing (FIG. 2), receives with its hub part 20 a journal pin 7. The journal pin is inserted in a bore of a partly axially slotted hub 23. The hub part comprises in the slotted area an externally located conical surface 24 and in the adjoining area an external thread 25, on which there is screwed a conical nut 26 which rests, with a conical inner surface, against the conical surface 24. After an exact axial alignment of the journal pin 7, the conical nut 26 is tightened so that the journal pin is exactly clamped in the roller holder 3. Like the hub 23, the journal pin 7 comprises a flat 27, so that the journal pin 7 is held in the roll holder 3 so as to be secured against rotation. The journal pin 7 comprises a screwed-on ring collar 28 which forms a bearing surface running in a guide 5. Contiguous thereto is another stepped ring collar 29, whose purpose will still be explained later. The outer end of the journal pin 7 is finally formed by a plastics material plug 30 which is intended to be supported on a housing wall 31 in the axial direction of the journal pin 7.

The hub area 20 of the opposite roll holder 4 is designed, for the optical effect, like the hub area of the roll holder 3, although this is not necessary for technical reasons. A bearing bush 32 is pressed with a flat, corresponding to the flat 27 of the hub 23, into the hub 23. The threaded nut 26 screwed on here, too, has no function 'per se'. It serves only for the optical adaptation to the other roll holder 3. Placed into the bearing bush 32 is the journal pin 8 with a cylindrical sliding surface 33, whose outer end carries a guard ring 34, by means of which the journal pin is secured against the bearing bush 32. Outside the bearing sleeve 32, there is arranged between the head of the journal pin 8 and the sliding surface 33 a compression spring 35 which is supported on the head of the journal pin and the bearing sleeve 32. The compression spring 35 thus seeks to press the head of the journal pin 8 to the outside and to press the entire arrangement of the two roll holders 3 and 4 with the sleeve 9 and the wound-up paper roll to the right towards the housing wall 31. The journal pin 8, which forms a sliding surface running in a guide 5, is also axially lengthened by a plastics material button, by means of which the journal pin is supported on the housing wall 36 which is opposite to the housing wall 31. Irrespective of the method of insertion used by the operator, the entire paper roll always has the position in which the journal pin 7 is supported, with the step forming the transition to the bearing surface 28, on the guide 5 which is secured to the housing wall 31 in an exactly aligned manner. It is therefore possible to align the roll holder 3 or the edge, bounded thereby, of the paper web wound on the sleeve 9 with respect to a feed strip of the copying apparatus.

In order to avoid that the paper roll 2, which is provided with the roll holders 3 and 4, is inserted with the wrong sides, the two journal pins 7 and 8 are given a different profiling, which allows them to be inserted only into their associated guides 5. To this end, the journal pin 7 is provided with the second ring collar 29. As is apparent from FIG. 1, there is attached to the guide 5, in the area of the inlet of the U-shaped slot, a stop 37, for example a screw, which is adapted to the ring collar 29. It is therefore impossible to introduce the other journal pin 8 into this guide 5.

In order to makie it additionally impossible for the roll holders 3 and 4 to be placed on the wrong front end of the sleeve 9, provision is made for one of the two roll holders 3 or 4 to be provided with a profiling which is adapted to a front-end profiling of the sleeve 9. It is expedient to provide the profiling on the roll holder 4 which does not carry the paper web side edge, which corresponds to a feed strip of the copying apparatus, so as to be able to avoid difficulties in the event of any tolerances if the roll holder 4 is not placed into the sleeve 9 in an entirely exact manner. The profiling consists expediently of one or several noses 38 which are advantageously attached to the rigid parts 21 of the roll holder 4. The noses 38, which may also be chamfered at the fronts, have a maximum height in the radial direction which equals the thickness of the sleeve 9. Their axial length is dimensioned so that they correspond to the cylindrical area of the lug 19, which is adjoined by a tapered part. The lugs 38 may be arranged at regular or irregular angular intervals. The sleeves 9 must, of course, be provided with appropriate notches which are provided only at one front end of the sleeve 9.

The different design of the journal pins 7 and 8 of the roll holders 3 and 4 and the different design of the roll holders 3 and 4 themselves, in conjunction with the varying design of the front ends of the sleeves 9, ensures that it is absolutely impossible to mistake the position of assembly, so that any trouble caused by an incorrect insertion of a new paper roll is prevented.

We claim:

1. In a copying apparatus comprising a housing having a pair of side walls spaced apart from each other, a guide attached to each housing wall, a sleeve mounted in the guides, and a paper roll wound on the sleeve, the provision of a pair of roll holders each having a hub frictionally engaging a respective end of the sleeve, and a journal pin in each roll holder engaging a respective guide, in which the sleeve has different shaped ends and the roll holders are of different shape to each other so that each roll holder will cooperate with one end of the sleeve but not the other end and the journal pins are of different form to each other and the guides are of different form to each other so that each pin will fit into one guide but not the other, whereby the sleeve can only be assembled one way round relative to the roll holders and the assembly of the sleeve and roll holders can only be mounted one way round relative to the guides.

2. A copying apparatus as claimed in claim 1, in which one roll holder is provided with a lug with which the other roll holder is not provided, and the sleeve is provided at one only of its ends with a notch to receive the lug, whereby the roll holder with the lug can only be mounted on the end of the sleeve which has the notch.

3. A copying apparatus as claimed in claim 1, in which only one journal pin is provided with a stepped collar and in which a lug projects into only one of the guides, so that the stepped collar can slide into the guide with the projection but the collar provided on the other journal pin cannot slide into the guide with the projection.

4. A copying apparatus as claimed in claim 1, in which the sleeve and roll holders are axially movably mounted in the guides and one of the journal pins is provided with a spring urging the sleeve longitudinally towards one of the guides.

5. A copying apparatus as claimed in claim 1, in which each roll holder comprises an annular flange and a hub, the hub having elastically resilient parts enabling the roll holders to frictionally engage the ends of the sleeve.

6. A copying apparatus as claimed in claim 1, in which there is provided a pair of take-off rollers into which the end of the paper is fed from the roll of paper on the sleeve, one of the take-off rollers being connected by a free wheel device to a lever so that the lever is free to rotate in one direction but when it is moved manually in the other direction it rotates the rollers and draws the paper through the rollers.

7. A copying apparatus as claimed in claim 6, in which one roller is held against the other by a spring and a stop is provided so that when the lever is urged against the stop one roller is moved away from the other against the action of the spring.

8. In a copying apparatus comprising a housing having a pair of side walls spaced apart from each other, a guide attached to each housing wall, a U-shaped slot in each guide, a sleeve, and a paper roll wound on the sleeve, the provision of a pair of roll holders each having a hub engaging a respective end of the sleeve, and a journal pin in each roll holder engaging a respective guide, in which the sleeve has a notch in one only of its ends and one only of the roll holders is provided with a lug engaging the notch, in which one journal pin has a cylinrical collar having a length equal to the thickness of the guide in which it fits and a diameter equal to the width between the arms of the U of the guide slot, and in which the other journal pin has a stepped collar and its associated guide has a projection.

* * * * *